US006158347A

United States Patent [19]

Neyer et al.

[11] Patent Number: 6,158,347

[45] **Date of Patent: *Dec. 12, 2000**

[54] DETONATOR

[75] Inventors: Barry T. Neyer, Cincinnati; John T. Adams, Bellbrook; Robert J. Tomasoski, Centerville, all of Ohio

[73] Assignee: EG&G Star City, Inc., Miamisburg, Ohio

[ * ] Notice: This patent is subject to a terminal disclaimer.

[21] Appl. No.: 09/017,283

[22] Filed: Feb. 2, 1998

Related U.S. Application Data

[62] Division of application No. 09/009,784, Jan. 20, 1998.

[51] Int. Cl.[7] ..... F42B 3/10

[52] U.S. Cl. ..... 102/202.7; 102/202.14

[58] Field of Search ..... 102/202.5, 202.14, 102/202.12, 202.7, 202.9, 204, 202, 202.8

[56] References Cited

U.S. PATENT DOCUMENTS

| | | | |
|---|---|---|---|
| H1214 | 8/1993 | Liva et al. . | |
| H1366 | 11/1994 | Bickes, Jr. et al. | 102/202.5 |
| Re. 34,790 | 11/1994 | Musk . | |
| 3,272,127 | 9/1966 | Betts et al. | 102/202.7 |
| 3,284,118 | 11/1966 | Kessler, Jr. . | |
| 3,362,329 | 1/1968 | Epstein . | |
| 3,528,372 | 9/1970 | Lewis et al. . | |
| 3,685,392 | 8/1972 | Platt . | |
| 3,724,383 | 4/1973 | Gallaghan et al. . | |
| 4,008,945 | 2/1977 | Schere . | |
| 4,265,511 | 5/1981 | Nicia et al. . | |
| 4,282,395 | 8/1981 | Hagemann . | |
| 4,343,242 | 8/1982 | Welk . | |
| 4,451,115 | 5/1984 | Nicia et al. . | |
| 4,471,697 | 9/1984 | McCormick et al. | 102/202.14 |
| 4,602,565 | 7/1986 | MacDonald et al. | 102/202.14 |
| 4,708,060 | 11/1987 | Bickes, Jr. et al. . | |
| 4,753,508 | 6/1988 | Meuleman . | |
| 4,807,958 | 2/1989 | Gunner et al. . | |
| 4,831,933 | 5/1989 | Nerheim et al. . | |
| 4,862,803 | 9/1989 | Nerheim et al. . | |
| 4,870,903 | 10/1989 | Carel et al. . | |
| 4,911,523 | 3/1990 | Sondergeld et al. . | |
| 4,917,014 | 4/1990 | Loughry et al. . | |
| 4,930,418 | 6/1990 | Folsom . | |
| 4,938,137 | 7/1990 | Guay | 102/202.7 |
| 5,046,423 | 9/1991 | Paisley . | |
| 5,094,166 | 3/1992 | Hendley, Jr. . | |
| 5,094,167 | 3/1992 | Hendley, Jr. . | |
| 5,104,747 | 4/1992 | Makino et al. . | |
| 5,138,946 | 8/1992 | Soltz et al. . | |
| 5,179,246 | 1/1993 | Betts et al. . | |
| 5,179,247 | 1/1993 | Hawley . | |
| 5,204,490 | 4/1993 | Soltz et al. . | |
| 5,206,455 | 4/1993 | Williams et al. . | |
| 5,247,595 | 9/1993 | Foldi . | |
| 5,275,106 | 1/1994 | Cutting et al. | 102/202.14 |
| 5,317,973 | 6/1994 | Winaver et al. . | |
| 5,337,387 | 8/1994 | Kramer . | |
| 5,370,053 | 12/1994 | Williams et al. | 102/202.14 |
| 5,370,054 | 12/1994 | Reams et al. | 102/202.5 |

(List continued on next page.)

FOREIGN PATENT DOCUMENTS

| | | |
|---|---|---|
| 2 669 724 | 11/1990 | France . |
| 1820180 | 11/1989 | U.S.S.R. . |
| PCT/US97/23842 | 12/1997 | WIPO . |

*Primary Examiner*—Harold J. Tudor
*Attorney, Agent, or Firm*—Kirk Teska; Iandiorio & Teska

[57] ABSTRACT

A detonator with a base portion including a header wall terminating in a support surface; an initiator on the support surface; an explosive charge spaced from the initiator; and a cap having an interior top surface and an enclosure wall extending downward from the interior top surface and surrounding the initiator and the explosive charge. The wall terminates in a rim secured at a location along the header wall corresponding to the thickness of the initiator, the spacing between the initiator and the explosive charge, and the thickness of the explosive charge thereby ensuring that the explosive charge is in communication with the interior top surface of the cap.

7 Claims, 4 Drawing Sheets

U.S. PATENT DOCUMENTS 5,404,820 4/1995 Hendrix .
5,431,101 7/1995 Arrell, Jr. et al. ..... 102/202.14
5,431,104 7/1995 Barker ..... 102/202.7
5,454,320 10/1995 Hilden et al. ..... 102/202.14
5,520,114 5/1996 Guimard et al. .
5,544,585 8/1996 Duguet ..... 102/202.5
5,573,565 11/1996 Dalton et al. .
5,621,183 4/1997 Bailey ..... 102/202.14
5,648,634 7/1997 Avory et al. ..... 102/202.14
5,664,040 9/1997 Kramer et al. .
5,845,578 12/1998 Fogle, Jr. ..... 102/202.5
5,912,427 6/1999 Willis et al. ..... 102/202.14
5,969,286 10/1999 Ward et al. ..... 102/202.7

DETONATOR

RELATED INVENTIONS

This application is a divisional application of U.S. application Ser. No. 09/009,784 entitled "Detonator" filed on Jan. 20, 1998 pending.

FIELD OF INVENTION

This invention relates to detonators and in particular to chip slapper type detonators and a method of making the same.

BACKGROUND OF INVENTION

Detonators are used to detonate a main charge such as an explosive of an air to surface missile. Such detonators are also used to detonate explosives used in other tactical devices, construction explosives, rocket boosters, and the like. These types of detonators must be physically robust and of high integrity. For example, an air to surface missile may be designed to pierce a bunker or other building and only then detonate the primary explosive. The detonator must, therefore, survive the shock of the launch and the impact with the bunker.

Exploding foil initiator ("EFI") detonators, (e.g. "chip slappers"), generally include a ceramic chip upon which is deposited two opposing conductive copper lands which taper to a narrow "bridge" portion therebetween. An electrical current is provided to the lands at the time of initiation and the bridge portion bursts sending a flying plate thereon into an explosive charge which, in turn, detonates the main charge.

It is convenient to package the chip and the explosive charge within a standard electronics housing such as a "TO" type transistor package including a base with one or more electrical leads and a can which covers the base. Such detonator packaging techniques, however, are fraught with problems.

First, one important design consideration is that the explosive charge must contact the inside top surface of the transistor package can in order to prevent energy losses.

Due to loose manufacturing tolerances, however, the length of the transistor can, the height of the header wall of the transistor base, the thickness of the explosive charge, and the thickness of the chip can all vary. To accommodate these variations and to ensure that the explosive charge is in intimate contact with the inside of the can, the prior art methods included forcing the total height of the components inside the can (e.g., the chip, the spacer, and the explosive charge) to always be greater than the length of the transistor can through the use of a resilient member or members disposed inside the can below the explosive charge. The resilient member is compressed by exerting pressure on the can and the rim of the can is then welded to the flange of the base.

One problem with this prior art design is the complexity involved in choosing the structure and orientation of the resilient member which often includes incorporating two explosive charges separated by the resilient member. And, these additional components add to the cost of the detonators and the man hours required for their fabrication.

Second, the lead posts of the transistor package base are typically connected to the lands of the chip slapper by individual wires. These wires tend to break in the harsh environment described above and/or burn under the application of high amperage current. In addition, securing the individual wires to the lands and lead posts involves a considerable amount of man hours.

One attempt at overcoming the breakage and burning problems includes interconnecting a number of individual wires from each lead to the lands thereby providing redundancy should any one wire break or burn. This solution, however, only adds to the complexity of the design and entails additional man hours required to interconnect each additional wire.

Another problem with present chip slapper detonator designs is that once the wires are in place, some kind of a mechanical spacer element must be placed between the EFI and the explosive charge to optimize the spacing therebetween thereby assuring that the flying plate travels the correct distance before striking the explosive charge. These mechanical spacer elements must be carefully designed and selected—often involving additional man hours in the fabrication of the detonators resulting in higher costs.

SUMMARY OF INVENTION

It is therefore an object of this invention to provide an improved detonator.

It is a further object of this invention to provide such an improved detonator which is easier to fabricate than prior art detonators.

It is a further object of this invention to provide such a detonator which eliminates the need for the mechanical spacer elements and the resilient members associated with prior art detonators.

It is a further object of this invention to provide such a detonator which is less expensive to manufacture than prior art detonators.

It is a further object of this invention to provide such an improved detonator which is physically robust and able to withstand violent environmental conditions.

It is a further object of this invention to provide such an improved detonator which facilitates the use of standard, low tolerance, low cost transistor packages.

It is a further object of this invention to provide such an improved detonator which incorporates low resistance electrical connections.

It is a further object of this invention to provide a method of manufacturing a physically robust detonator.

This invention results from the realization that the complexity of prior art spacer elements and resilient devices used to ensure that the explosive charge of the detonator remains in contact with the top of the can of a standard transistor package can be eliminated by instead ensuring that the internal detonator components are of a sufficient height such that the rim of the can does not extend all the way down to the flange of the base and then laser welding the rim to the header wall instead of the flange of the base thus rendering irrelevant the loose manufacturing tolerances of the inexpensive transistor packages.

This invention features a detonator comprising a base portion including a header wall terminating in a support surface; an initiator on the support surface; an explosive charge spaced from the initiator; and a cap having an interior top surface and an enclosure wall extending downward from the interior top surface and surrounding the initiator and the explosive charge. The wall terminates in a rim secured at a location along the header wall corresponding to the thickness of the initiator, the spacing between the initiator and the explosive charge, and the thickness of the explosive charge thereby ensuring that the explosive charge is in communication with the interior top surface of the cap.

A laser weld typically secures the rim of the cap to the header wall. The base portion is a preferably TO type transistor header and the cap is preferably a TO type transistor can. In a preferred embodiment, the base portion includes electrical leads and the initiator includes at least two conductive lands separated by a bridge portion therebetween. The detonator then further comprises a connecting barrel of a predetermined thickness located on the initiator for optimizing the spacing between the initiator and an explosive charge and for robustly interconnecting the lands of the initiator with the electrical leads of the base portion. The connecting barrel includes a conductive surface extending between the leads of the base portion and the lands of the initiator, and an opening in the conductive surface located over the bridge portion of the initiator. The initiator may be an exploding foil type initiator ("EFI"), other types of chips slappers, or other types of initiators.

The barrel typically includes a top insulating layer laminated to a bottom conductive layer, the conductive surface formed by etching away the conductive layer from selected portions of the insulating layer. The opening in the conductive surface of the barrel usually extends through the top insulating layer. The insulating layer is preferably polyimide and the conductive layer preferably is copper. The conductive surface usually includes at least one plate having the shape of an annular sector. The conductive surface preferably has a broad distal end for simultaneously covering a plurality of leads on one side of the base portion and a tapered proximal end connected to a land of the initiator. In the preferred embodiment, the conductive surface forms two conductive plates separated by the opening.

This invention also features a detonator comprising a TO type base portion including a header wall terminating in a support surface; an initiator on the support surface; an explosive charge spaced from the initiator; and a TO type cap having an interior top surface in communication with the explosive charge and an enclosure wall extending downward from the interior top surface and surrounding the initiator and the explosive charge. The wall terminates in a rim secured at a location along the header wall corresponding to the thickness of the initiator, the spacing between the initiator and the explosive charge, and the thickness of the explosive charge thereby ensuring that the explosive charge is in communication with the interior top surface of the cap.

This invention also features a method of making a detonator, the method comprising securing an initiator on a support surface of a base portion having a header wall; placing an explosive charge in a spaced relationship with respect to the initiator; and securing a cap over the initiator and the explosive charge such that the rim of the cap is attached at a location along the header wall of the base portion corresponding to the thickness of the initiator, the spacing between the initiator and the explosive charge, and the thickness of the explosive charge thereby ensuring that the explosive charge is in communication with the interior top surface of the cap.

In one embodiment, there is a base portion having a header wall of height h terminating in a support surface; an initiator on the support surface; an explosive charge spaced from the initiator wherein the thickness of the initiator, the thickness of the explosive charge, and the spacing between the initiator and the explosive charge totals a height H; and a cap having an interior top surface and an enclosure wall of length l extending downward from the interior top surface and surrounding the initiator and the explosive charge, the wall terminating in a rim. The length of the enclosure wall l is greater than the height H and less than the sum total of H and the height of the header wall h such that the rim of the enclosure wall can be secured at a number of different locations along the header wall.

Further included is a connecting barrel between the initiator and the explosive charge comprising a laminate of a predetermined thickness for optimizing the spacing between the initiator and the explosive charge; the laminate including a conductive surface for electrically interconnecting the initiator with the detonator in a robust fashion; and an opening in the conductive surface.

The laminate typically includes an insulating layer and the opening then extends through the insulating layer. The conductive surface usually includes two discrete conductive plates. Each discrete conductive plate forms an annular sector on the insulating layer. Each discrete conductive plate has a broad distal end for simultaneously covering a plurality of leads on one side of the detonator and a proximal end connected to a land of the initiator.

DISCLOSURE OF PREFERRED EMBODIMENT

Other objects, features and advantages will occur to those skilled in the art from the following description of a preferred embodiment and the accompanying drawings, in which.

Figure 1:
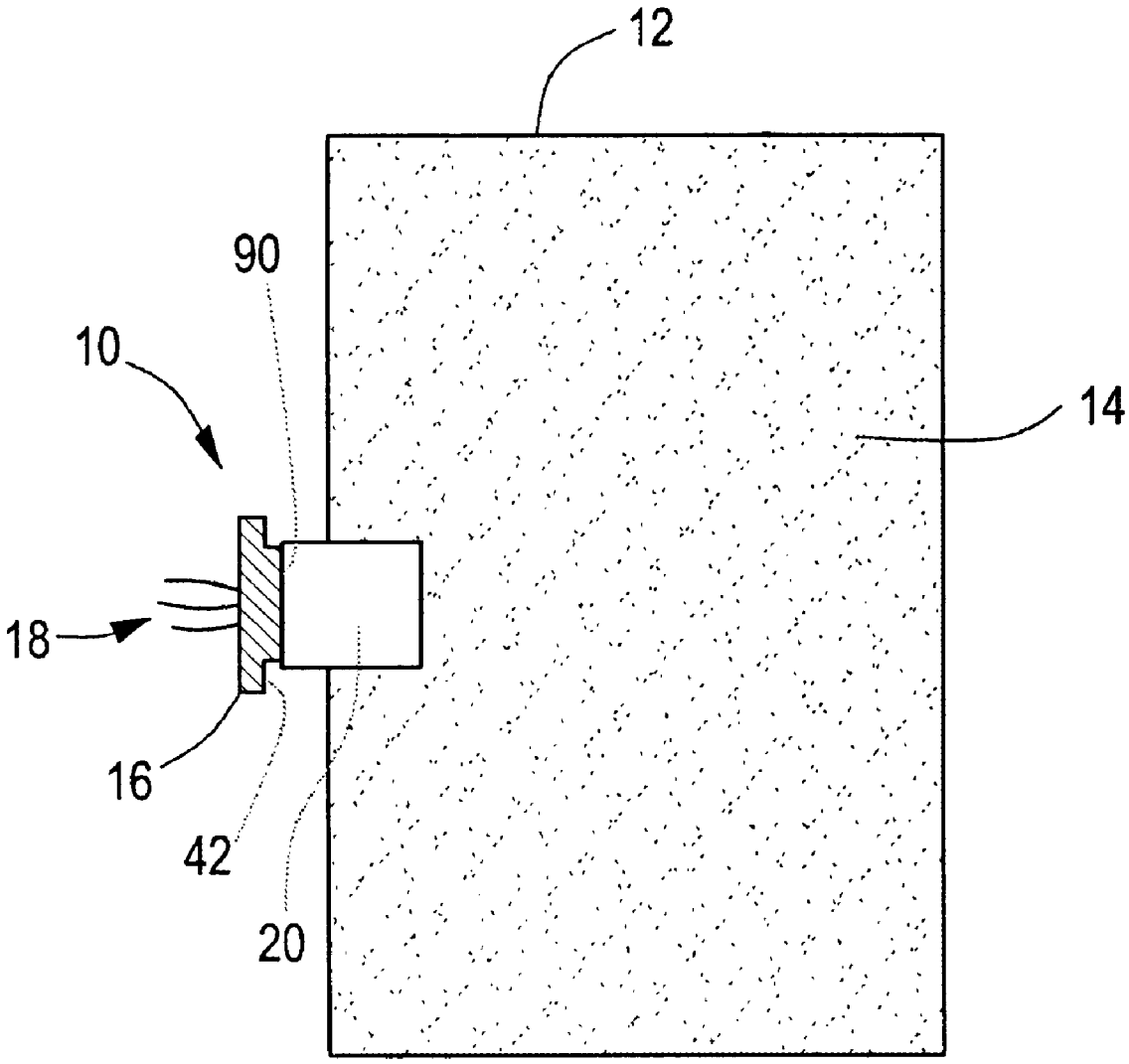
FIG. 1 is a schematic side sectional view of the detonator of this invention in place within a bulkhead containing a main charge to be detonated.

Detonator 10, FIG. 1, in accordance with this invention is typically an exploding foil initiator chip slapper type detonator as discussed in the Background of the Invention above and may be installed in bulkhead 12 enclosing main charge 14. For example, main charge 14 may be the explosive component of an air to surface missile to be detonated by detonator 10 upon the occurrence of some preestablished criteria such as the impact of the missile with a building or bunker. In accordance with the subject invention, detonator 10 is housed in a standard transistor "TO" type package including base 16 with leads 18 and can or cap 20. Cap 20 may have a diameter of about 0.300 inches and a length of about 0.220 inches. Thus, detonator 10 is relatively small and compact.

Figure 2:
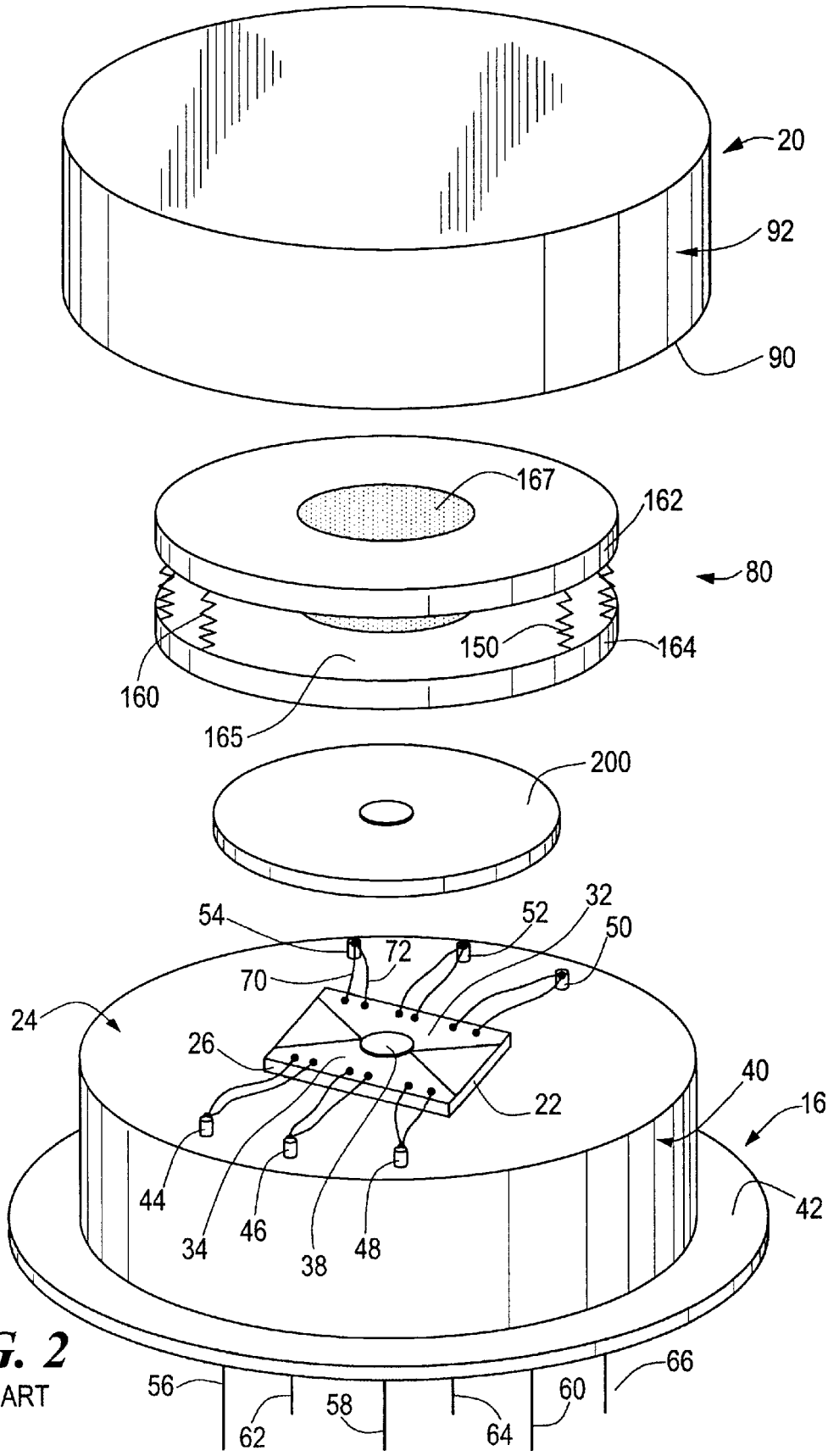
FIG. 2 PRIOR ART
FIG. 2 is a schematic exploded view of a prior art detonator including two charges separated by resilient member and a number of individual lead post connecting wires.

In the prior art, as discussed in the background of the invention above, rim 90 of cap 20 is constrained to be welded to flange 42 of base 16, as shown more clearly in FIG. 2. Prior art detonators of this type include chip slapper 22, FIGS. 2 and 3 residing on support surface 24 of transistor base 16. Chip slapper 22 includes chip base 26 made of an insulating material, usually ceramic. Conductive copper lands 32 and 34, deposited on base 26, are separated by or joined by narrow bridge portion 36. Flying plate 38 (e.g. a piece of polyimide) is secured over bridge portion 36. Base 16 also includes header wall 40, flange 42, and lead contact posts or pins 44, 46, 48, 50, 52, and 54 rising above support surface 24. The lead posts may alternatively extend through the side of base 16. Lead posts 44, 46, and 48 terminate in lead wires 56, 58, and 60, respectively, while lead posts 50, 52, and 54 terminate in lead wires 62, 64, and 66, respectively. There may be more or fewer lead posts and extending leads (see leads 18, FIG. 1) depending on the specific design but in general there are usually two sets of opposing lead posts or pins on opposite sides of chip slapper 22 secured to surface 24. One set of lead posts is adjacent one conductive land of the chip slapper and the other set of lead posts is adjacent the other conductive land. Additional sets of lead posts or pins could be used for other functions such as a four-wire measurement of the bridge resistance.

Explosive charge assemblies 162 and 164 each include, as shown for charge assembly 164, optional metal sleeve 165 housing explosive 167. Charge 164 is oriented such that there is an exact and proper spacing between flying plate 38 and explosive 167. In the prior art, this is usually accomplished by using mechanical spacer element 200 disposed between support surface 24 of base 16 and explosive charge 164. Besides the exact spacing of flying plate 38 with respect to explosive charge 164, another important design consideration is that an explosive charge must be in intimate contact with the interior top surface of can or cap 20. To meet this requirement, the prior art incorporated resilient members 150 and 160 separating explosive charges 162 and 164 so that explosive charge 162 remains in contact with interior top surface 120 of can 20. Transistor can 20 is placed over this assembly and rim 90 of circular enclosure wall 92 is welded to disc shaped flange 42 of base 16.

To initiate detonation, a high amperage electrical current is applied, for example, to lead wires 56, 58, and 60 in electrical contact with lead posts 44, 46, and 48. Narrow bridge portion 36 between or interconnecting opposing conductive lands 34 and 32 cannot withstand high amperage current and thus clip slapper 22 bursts and sends flying plate 38 to strike explosive 167 of charge 164 which, in turn, explodes thereby detonating explosive charge 162 which, in turn detonates main explosive 14, FIG. 1.

In this prior art device, rim 90, FIG. 2 of enclosure wall 92 of can 20 is constrained by design to engage flange 42. The reason is that the length of wall 92 is constrained to be exactly equal to the sum of the height of header wall 40 plus the total thickness of the components inside can 20. But, since the length of wall 92 and the height of header wall 40 often vary due to the low cost and loose manufacturing tolerances inherent in standard transistor components, the only way to force this relationship is to use two explosive charges 164 and 162 separated by resilient members such as springs 150 and 160. The use of two separate explosive charges and springs 150 and 160 results in an extraordinary amount of extra design and manufacturing considerations.

Figure 3:
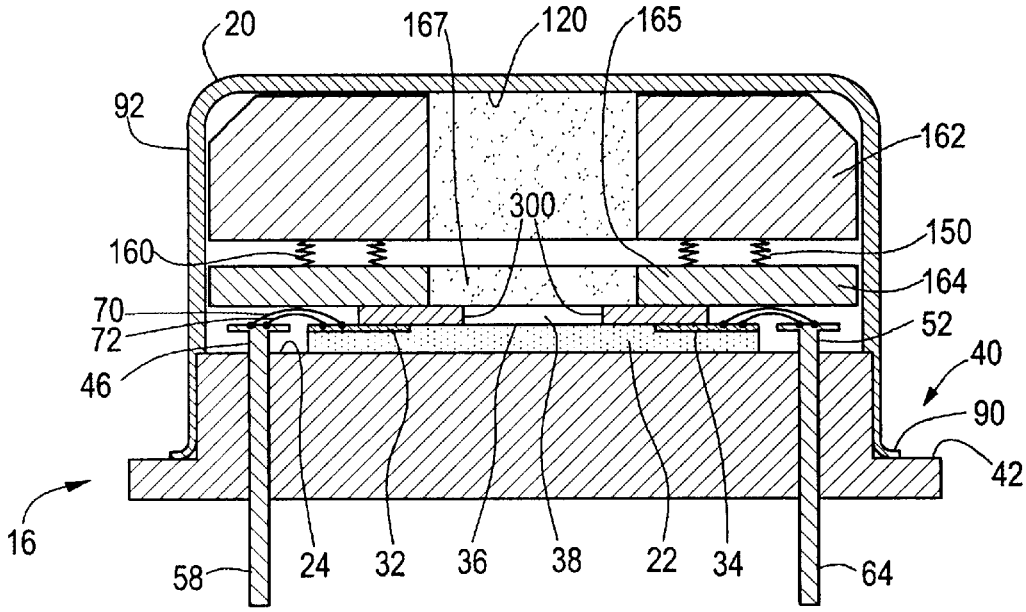
FIG. 3 PRIOR ART
FIG. 3 is a schematic side sectional view of a complete prior art detonator assembly.
Figure 4:
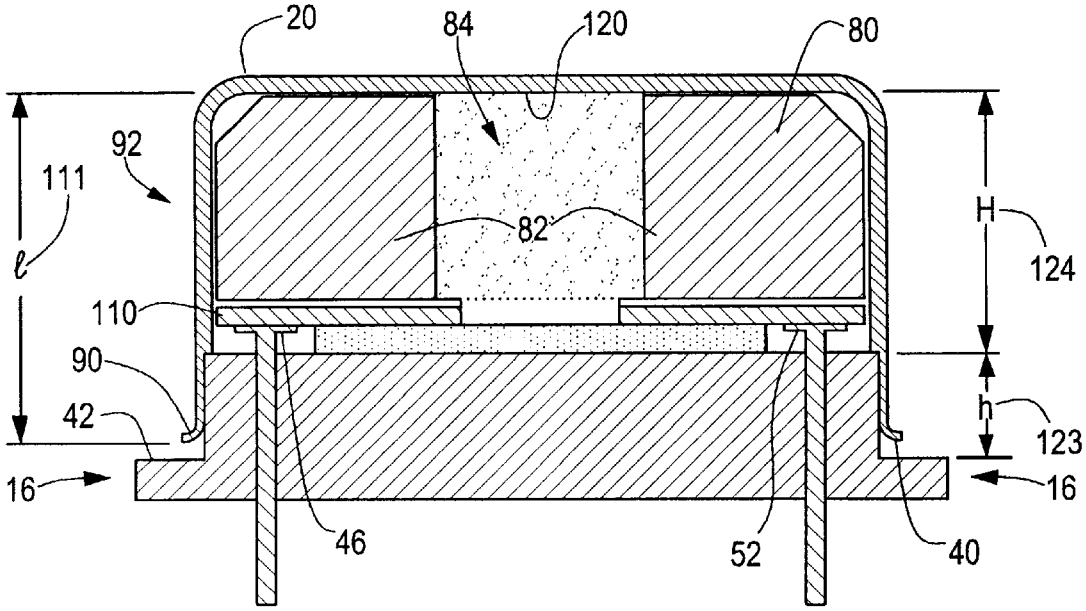
FIG. 4 is a schematic side sectional view of the complete detonator assembly of the subject invention.

The subject invention, however, requires only one explosive charge, namely charge 80, FIG. 4, and springs 160 and 164, FIG. 3 are eliminated. In order to ensure that explosive charge 84, FIG. 4 of charge assembly 80 is in intimate contact with interior top surface 120 of cap or can 20 in light of the loose tolerances and thus varying lengths l, 111 of enclosure wall 40 of can 20 and varying heights h, 123 of header wall 40 of base 16 (common in the manufacturing of standard, low cost transistor bases and cans), and thickness of spacer barrel 110, the length (l) of enclosure wall 40 is selected such that the thickness of chip slipper 22 and the thickness of explosive charge 80 when combined with the thickness of barrel 110 has a height H, 124 sufficient to ensure that rim 90 of cap 20 does not engage flange 42 of base 16.

In other words, the loose manufacturing tolerances which lead to variable height (h) header walls 40 and variable length (l) can enclosure walls 92 are rendered irrelevant by the subject invention because rim 90 of enclosure wall 92 is not constrained to be welded to flange 42 and instead may be secured at any location along header wall 40 corresponding to the height (H) of chip slapper 22, barrel 110, and charge 80 at the same time ensuring that explosive charge 80 is in communication with interior top surface 120 of cap 20 so long as the following mathematical relationship is satisfied:

$$H<l<H+h \tag{1}$$

For example, if H is 0.200 inches (barrel 110 being 0.010 inches thick, chip 22 being 0.030 inches thick, and charge 80 being 0.160 inches thick which are typical values) and h, the height of header wall 40 is 0.045 inches (also a typical value) then l, the length of enclosure wall 92 can range from about 0.210 to 0.230 inches.

The subject invention thus uniquely takes into account the varying sizes of available explosive charge components 80, the thickness of a currently available chip slapper components 22, and the wide range in manufacturing tolerances related to header wall 40, and the length l of enclosure wall 92 of standard transistor TO type packages. Thus, l, H, and h can vary somewhat due to loose manufacturing tolerances but the subject invention renders these loose tolerances irrelevant.

In contrast, prior art devices required a plurality of resilient members, conceptually represented by springs 150 and 160, FIGS. 2 and 3 disposed between separate charges 162 and 164 in order to ensure that rim 90 of enclosure wall 92 can always be forced down onto flange 42 and welded thereto.

Figure 5:
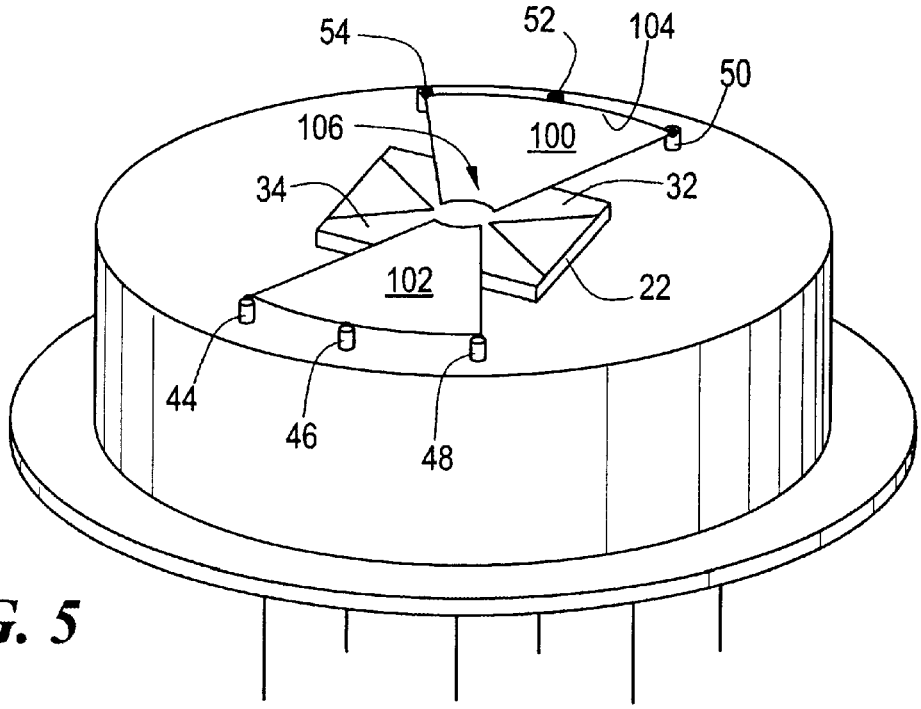
FIG. 5 is a schematic view of the base portion of the detonator in accordance with this invention.

Also, in accordance with the subject invention, electrical connecting wires such as wires 70 and 72, FIGS. 2 and 3 are replaced with some kind of a conductive surface, for example robust conductive plates 100 and 102, FIG. 5 extending between lead posts 44, 46, and 48 and land 34; and between lead posts 50, 52, 54 and conductive land 32, respectively. Conductive plates 100 and 102 are preferably made of copper or some other conductive material and are in the shape of an annular sector, as shown, each including broad distal end 104 which simultaneously covers lead posts 50, 52, and 54. Broad distal end 104 tapers to proximal end 106 connected to land 32 of chip slapper. Conductive plate 102 is of a similar construction but oriented to interconnect lead posts 44, 46 and 48 to land 34.

Figure 6:
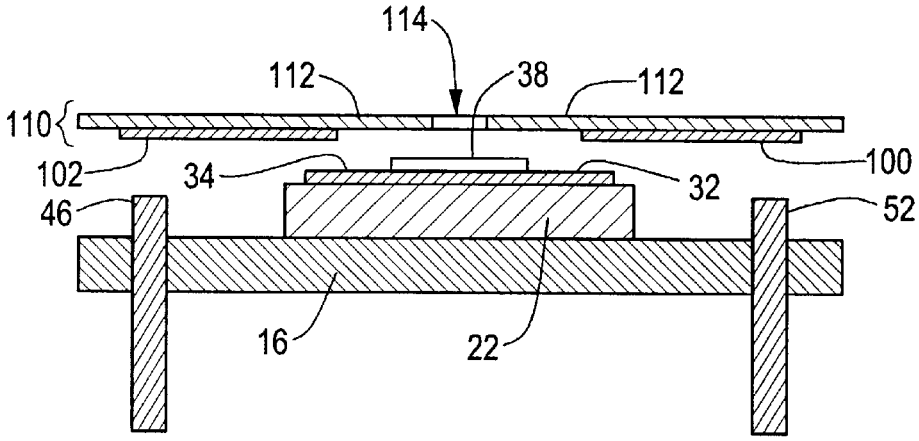
FIG. 6 is a side sectional partially exploded view of a preferred embodiment of the connecting barrel of this invention.
Figure 7:
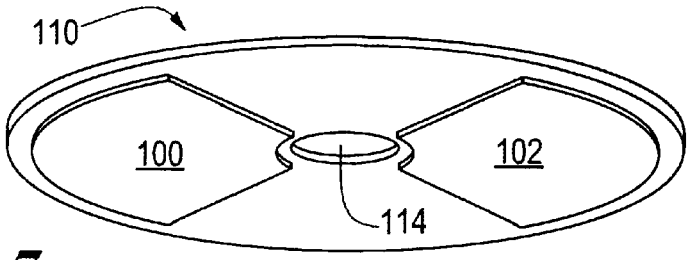
FIG. 7 is a schematic three dimensional view of the bottom portion of the connecting barrel shown in FIG. 4.

Conductive copper plates 100 and 102 are preferably part of laminated spacer barrel 110, FIGS. 4, 6 and 7 which includes top insulating layer 112, FIG. 6 and a bottom conductive layer configured into conductive plates 100 and 102. In this embodiment, barrel 110 is in the form of a laminate including an insulating layer made of polyimide such as the "Kapton" product available from DuPont, Inc., and a conductive copper layer. Insulating layer 112 shields lands 32 and 34, FIG. 5 from electrical contact with explosive charge 80, FIG. 4. In some cases, insulating layer 112 may be eliminated. The copper layer is preferably etched away in certain areas forming conductive plates 100 and 102. Then, opening 114, FIGS. 6 and 7 is formed to be placed over the bridge portion and flying plate 38 of chip slapper 22 so that nothing interferes with its travel to the explosive charge. The opening may extend through both the top insulating layer 112 and separate conductive plates 100 and 102 or, depending on the thickness of insulating layer 112, may simply separate conductive plates 100 and 102 and not extend through insulating layer 112.

The thickness of barrel 110 is selected to optimize the spacing between chip slapper 22, FIG. 4 and explosive component 84 of explosive charge 80. Thus, barrel 110 acts not only as the electrical connection between the contact posts of the detonator base and the lands of the chip slapper, but also simultaneously acts as a spacer between chip slapper 22 and explosive charge 80 to ensure that flying chip 38 travels the correct distance before striking explosive 84. This dual purpose function of barrel 110 eliminates fragile wire connections 70 and 72, FIG. 2 and separate mechanical spacer 200 of the prior art design. If other initiators besides chip slapper 22 are used in a detonator of a specific design, barrel 110 may be modified accordingly. For example, chip slapper 22 could be a microclad slapper or any other type of slapper device.

In any case, connecting spacer barrel 110, FIGS. 4, and 6–7 provides the dual function of interconnecting the electrical posts of the base portion with the lands of the EF and properly spacing the flying chip of the EFI with respect to the explosive charge. Broad conductive plates 100 and 102, FIGS. 7 typically one mil thick, are electrically more efficient that wires 70 and 72, FIGS. 2 and 3 since they incorporate more copper and thus offer lower resistance. Plates 100 and 102, FIG. 7 are not susceptible to breakage like wires 70 and 72 thus providing a physically robust electrical interconnection. Indeed, even if the solder bond connecting conductive plates 100 and 102 to lead posts 46 and 52, FIG. 5 breaks, barrel 110, FIG. 4 is constrained within transistor cap 20 and cannot move to any great extent. Thus, contact between conductive plates 100 and 102 and the lead posts is maintained due to barrel 110 being constrained within cap 20 between chip 22 and charge 80. Thus, plates 100 and 102 will remain in electrical contact and extend between the electrical posts and the lands of the chip slapper even when subject to rapid acceleration and deceleration forces.

Assembly of detonator 16, FIG. 4, is accomplished by first fabricating barrel 110, FIG. 7. The copper layer of polyimide copper laminate is etched from the polyimide layer to form conductive plates 100 and 102. Opening 114 is then punched through the polyimide layer. Chip 22, FIG. 4 is then placed on the support surface of a standard TO base and secured thereto with an epoxy, adhesive, etc. Barrel 110 is then placed over chip 22 such that the broad distal ends of each conductive plate contact all of the adjacent lead posts of the base and the tapered proximal ends contact the lands of the chip. Solder, anisotropically conductive adhesives, conductive epoxies, and other similar conventional technologies can be used to provide the connection between the conductive plates and both the lands of the chip and the lead posts of the transistor base. Explosive charge assembly 80, FIG. 4 is then placed directly on top of barrel 110 and cap or can 20 is placed over all of these interior components thus enclosing them. Rim 90 of cap 20 is then welded (e.g. using a YAG laser) at the appropriate location along the height of header wall 40 by laser welding such that inside the top surface 120 of can 20 is in intimate contact with explosive material 84 of explosive charge 80.

The result is a physically robust detonator able to withstand even violent environmental conditions housed in standard, loose tolerance, inexpensive transistor packages. The detonator of this invention is easier to fabricate than prior art detonators because there is no need for wires, spacers, or resilient devices.

Connecting barrel 110, FIGS. 4, 6, and 7 simultaneously provides the proper spacing between flying plate 38, FIG. 6 and explosive charge 80, FIG. 4 (eliminating the need for mechanical spacer 200, FIG. 2). Conductive plates 100 and 102, FIGS. 5 and 7 are broad enough to cover all the lead posts on the base and long enough to cover the span between the lead posts and the lands of the chip slapper thereby eliminating fragile wires 70, 72, FIG. 2 used in the design of prior art detonators.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A detonator comprising:

a TO type base portion having a header wall of height h terminating in a support surface;

an exploding foil initiator on the support surface;

an explosive charge spaced from the initiator by a barrel wherein the thickness of the initiator, the thickness of the explosive charge, and the thickness of the barrel totals a height H; and a TO type cap having an interior top surface and an enclosure wall of length l extending downward from the interior top surface and surrounding the initiator, the barrel and the explosive charge, the enclosure wall terminating in a rim, the length of the enclosure wall l being greater than the height H and less than the sum total of H and the height of the header wall h such that the rim of the enclosure wall can be secured at one of a number of different locations along the header wall depending on varying dimensions for h, H, and l such that the explosive charge is in contact with the interior top surface of the TO type cap, the barrel is in contact with the explosive charge, and the initiator is in contact with the barrel.

2. The detonator claim 1 further in which the barrel comprises:

a laminate of a predetermined thickness for optimizing the spacing between the initiator and the explosive charge;

the laminate including an insulative substrate and two conductive surfaces thereon for electrically interconnecting the initiator with leads in a robust fashion; and an opening between the two conductive surfaces.

3. The barrel of claim 2 in which and the opening extends through the insulative substrate.

4. The barrel of claim 2 in which the two conductive surfaces include two discrete conductive plates.

5. The barrel of claim 4 in which each discrete conductive plate forms an annular sector on the insulative substrate.

6. The barrel of claim 3 in which the insulative substrate is polyimide and the conductive surfaces are copper.

7. The connecting barrel of claim 4 in which each discrete conductive plate has a broad distal end for simultaneously covering a plurality of leads on one side of the detonator and a narrower proximal end connected to a land of the initiator.

* * * * *